US006209149B1

(12) United States Patent
Song et al.

(10) Patent No.: US 6,209,149 B1
(45) Date of Patent: Apr. 3, 2001

(54) INFLATABLE SWIMMING POOL WITH A SUN SHIELD

(75) Inventors: Rong-Jyh Song; Tsung-Ping Yen, both of Taipei (TW)

(73) Assignee: Aqua-Marine International Inc., Taipei (JP)

( * ) Notice: Subject to any disclaimer, the term of this patent is extended or adjusted under 35 U.S.C. 154(b) by 0 days.

(21) Appl. No.: 09/551,025

(22) Filed: Apr. 17, 2000

(51) Int. Cl.[7] ..... E04H 4/10
(52) U.S. Cl. ..... 4/498; 4/503; 441/38
(58) Field of Search ..... 4/494, 496, 498, 4/499, 503; 441/38; 52/211; 135/96

(56) References Cited

U.S. PATENT DOCUMENTS 5,919,068 * 7/1999 Schulze ..... 441/38
5,924,144 * 7/1999 Peterson ..... 4/503 X
6,105,181 * 8/2000 Brandner ..... 4/498

* cited by examiner

*Primary Examiner*—Robert M. Fetsuga
(74) *Attorney, Agent, or Firm*—Pitney, Hardin, Kipp & Szuch LLP

(57) ABSTRACT

An inflatable swimming pool assembly includes an inflatable swimming pool with a peripheral wall that has a top surface, a first half and a second half. A sun shield has a flexible sunshade portion with two opposite sides, which are formed respectively with a curved first inflatable tube and a curved second inflatable tube. The first inflatable tube has two ends that are respectively in fluid communication with two ends of the second inflatable tube at two intersections. Two fastener units attach respectively the intersections of the sun shield to two diametrically opposed portions of the top surface of the peripheral wall of the pool, such that the sun shield can rotate on the top surface of the peripheral wall about a connecting line of the intersections between a first position, where the first inflatable tube rests entirely on the first half of the pool and where the second inflatable tube forms an angle with the top surface of the peripheral wall, and a second position, where the second inflatable tube rests on the second half of the pool and where the first inflatable tube forms an angle with the top surface of the peripheral wall of the pool.

4 Claims, 3 Drawing Sheets

INFLATABLE SWIMMING POOL WITH A SUN SHIELD

BACKGROUND OF THE INVENTION

1. Field of the Invention

The present invention relates to a swimming pool, more particularly to an inflatable swimming pool with a sun shield.

2. Description of the Related Art

A conventional inflatable swimming pool assembly for children generally includes a pool that is made of a flexible material and that has a flat bottom and a peripheral wall which cooperates with the bottom to define a water receiving space therebetween so that children can play with water within the pool.

However, in case, the pool is exposed under the sun, the children playing therein may suffer from sunburn due to prolonged exposure to the sun.

SUMMARY OF THE INVENTION

Therefore, the object of this invention is to provide an inflatable swimming pool with a sun shield so as to avoid the drawbacks that generally result from the use of the conventional inflatable swimming pool assembly.

Accordingly, an inflatable swimming pool assembly of the present invention includes an inflatable swimming pool with a peripheral wall that has a top surface, a first half and a second half. A sun shield has a flexible sunshade portion with two opposite sides, which are formed respectively with a curved first inflatable tube and a curved second inflatable tube. The first inflatable tube has two ends that are respectively in fluid communication with two ends of the second inflatable tube at two intersections. Two fastener units attach respectively the intersections of the sun shield to two diametrically opposed portions of the top surface of the peripheral wall of the pool. Thus, the sun shield can rotate on the top surface of the peripheral wall about a connecting line of the intersections between a first position, where the first inflatable tube rests entirely on the first half of the pool, and where the second inflatable tube forms an angle with the top surface of the peripheral wall, and a second position, where the second inflatable tube rests entirely on the second half of the pool and where the first inflatable tube forms an angle with the top surface of the peripheral wall of the pool.

BRIEF DESCRIPTION OF THE DRAWINGS

Other features and advantages of this invention will become more apparent in the following detailed description of a preferred embodiment of this invention, with reference to the accompanying drawings, in which.

DETAILED DESCRIPTION OF THE PREFERRED EMBODIMENT

Figure 1:
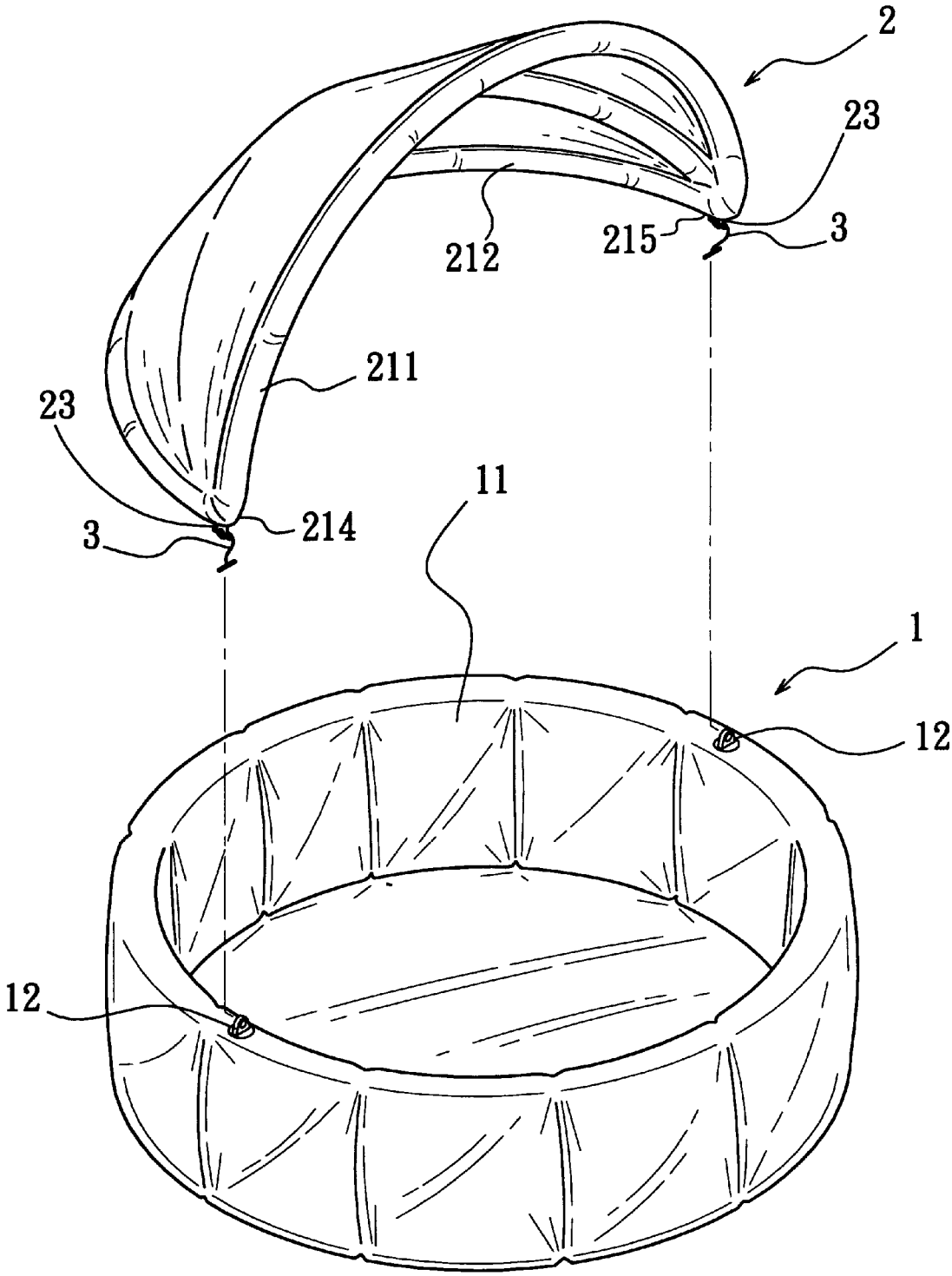
FIG. 1 is an exploded perspective view of the preferred embodiment of an inflatable swimming pool of the present invention.
Figure 2:
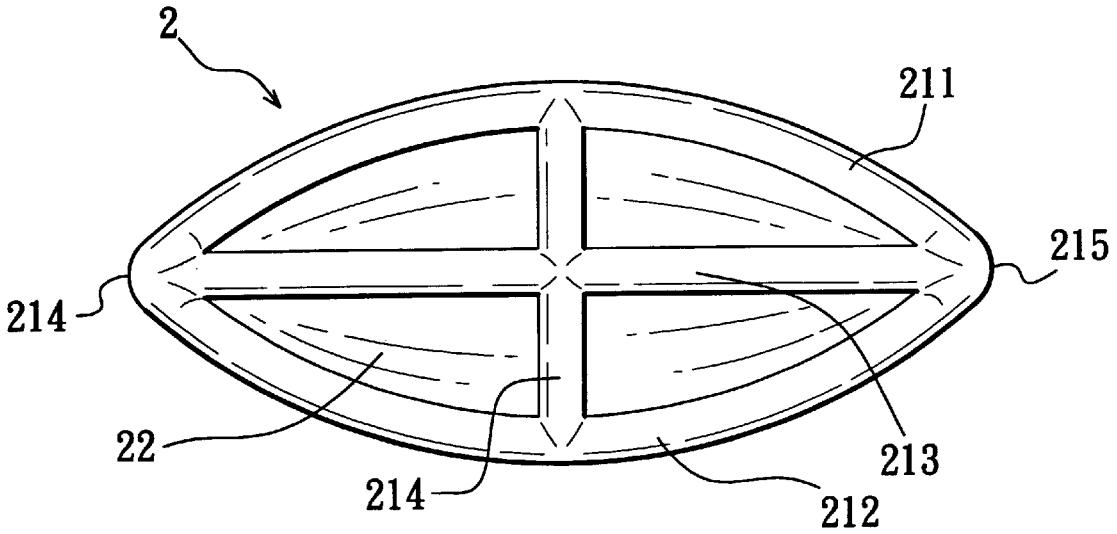
FIG. 2 is a schematic view of a sun shield employed in the preferred embodiment.

Referring to FIGS. 1 and 2, the preferred embodiment of an inflatable swimming pool assembly of the present invention is shown to include an inflatable swimming pool 1, a sun shield 2, and two fastener units.

Figure 3:
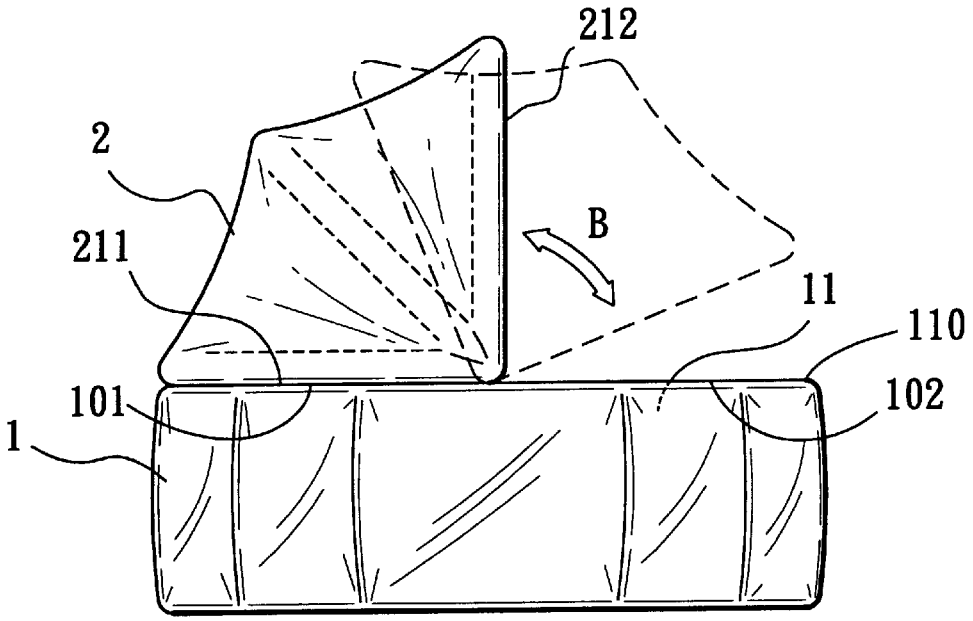
FIGS. 3 and 3A respectively illustrate two positions of the sun shield of the preferred embodiment in use.
Figure 3A:
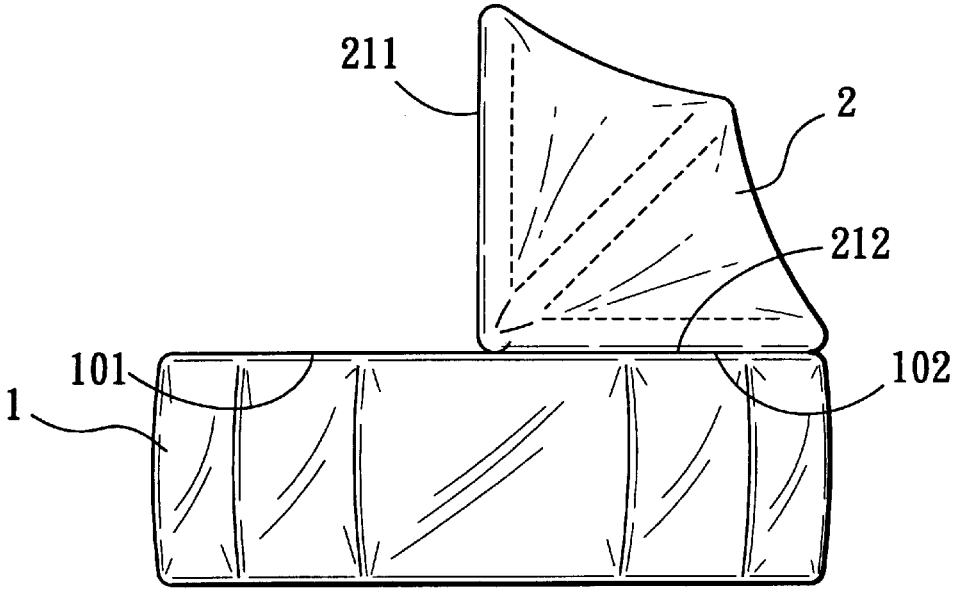

As illustrated, the inflatable swimming pool 1 includes a peripheral wall 11 that has a top surface 110, a first half 101, and a second half 102 (see FIGS. 3 and 3A).

The sun shield 2 has a flexible sunshade portion 22 with two opposite sides, which are formed respectively with a curved first inflatable tube 211 and a curved second inflatable tube 212 that are fixed thereon. The first inflatable tube 211 has two ends that are respectively in fluid communication with two ends of the second inflatable tube 212 at two intersections 214,215.

The fastener units attach respectively the intersections 214,215 of the sun shield 2 to two diametrically opposed portions of the top surface 110 of the peripheral wall 11 of the pool 1, such that the sun shield 2 can rotate on the top surface 110 of the peripheral wall 11 of the pool 1 about a connecting line of the intersections 214,215 between a first position, as best shown in FIG. 3, where the first inflatable tube 211 rests entirely on the first half 101 of the peripheral wall 11 of the pool 1 and where the second inflatable tube 212 forms an angle with the top surface 110 of the peripheral wall 11 of the pool 1, and a second position as best shown in FIG. 3A, where the second inflatable tube 212 rests entirely on the second half 102 of the peripheral wall 11 of the pool 1 and where the first inflatable tube 211 forms an angle with the top surface 110 of the peripheral wall 11 of the pool 1.

In the preferred embodiment, the first and second inflatable tubes 211, 212 of the sun shield 2 are generally perpendicular to each other. The sun shield 2 further has a cross-shaped inflatable tube unit, which includes a long tubular portion 213 with two ends that are respectively in fluid communication with the intersections 214,215 of the first and second inflatable tubes 211,212, and a short tubular portion 214 that has a middle portion crossing and in fluid communication with the long tubular portion 213, and two ends that are respectively in fluid communication with middle portions of the first and second inflatable tubes 211,212.

Figure 4:
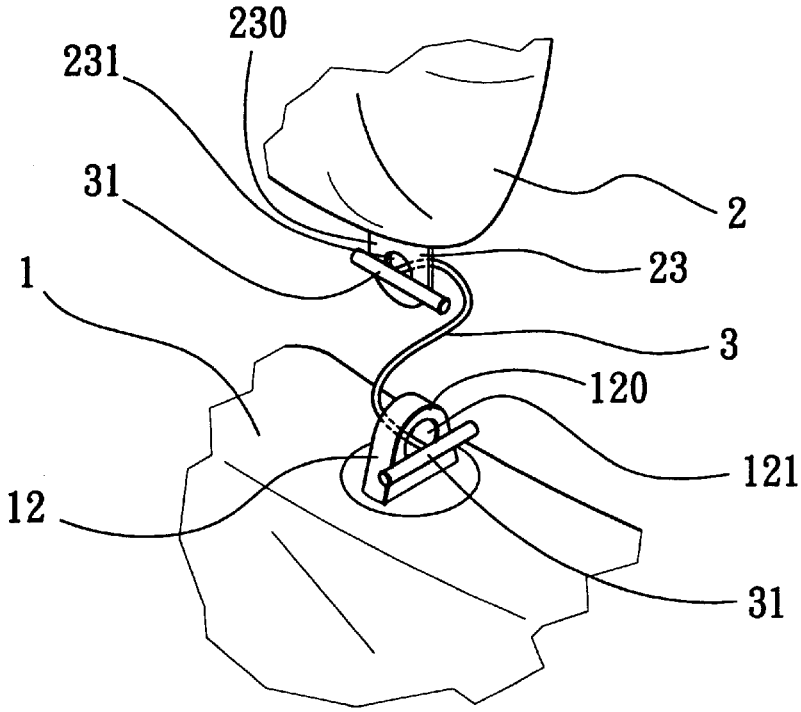
FIG. 4 illustrates how two fastener units attach the sun shield to an inflatable swimming pool in the preferred embodiment.

Referring to FIG. 4, each of the fastener units includes first and second lugs 12, 23 and a fastener cord 3. The first lug 12 is fixed on the top surface 110 of the peripheral wall 11 of the pool 1 between the first and second halves 101,102. The first lug 12 has a side surface 120 and a hole 121 formed therethrough. The second lug 23 is fixed on a corresponding one of the intersections 214,215 of the sun shield 2 near the first lug 12, and has a side surface 230 and a hole 231 that is formed therethrough. The fastener cord 3 has two opposite ends that extend through the holes 121, 231 in the first and second lugs 12,23. Two stop rods 31 are attached respectively to the ends of the cord 3. Each of the rods 31 is connected fixedly to the cord 3 at a middle portion thereof, and abuts against the side surfaces 120,230 of the first and second lugs 12,23 at two end portions thereof for retaining the intersections 214,215 of the sun shield 2 on the pool 1.

For storage and transport, the pool 1, the first and second inflatable tubes 211, 212, and the cross-shaped inflatable tube unit of the sun shield 2 can be deflated so as to occupy little storage space. With this invention thus explained, it is apparent that numerous modifications and variations can be made without departing from the scope and spirit of this invention. It is therefore intended that the invention be limited only as indicated in the appended claims.

We claim:

1. An inflatable swimming pool assembly comprising:

an inflatable swimming pool with a peripheral wall that has a top surface, a first half and a second half;

a sun shield having a flexible sunshade portion with two opposite sides, which are formed respectively with a curved first inflatable tube and a curved second inflatable tube that are fixed thereon, said first inflatable tube having two ends that are respectively in fluid communication with two ends of said second inflatable tube at two intersections; and two fastener units attaching respectively said intersections of said sun shield to two diametrically opposed portions of said top surface of said peripheral wall of said pool, such that said sun shield can rotate on said top surface of said peripheral wall of said pool about a connecting line of said intersections between a first position, where said first inflatable tube rests entirely on said first half of said pool and where said second inflatable tube forms an angle with said top surface of said peripheral wall of said pool, and a second position, where said second inflatable tube rests entirely on said second half of said pool and where said first inflatable tube forms an angle with said top surface of said peripheral wall of said pool.

2. The inflatable swimming pool assembly as defined in claim 1, wherein said first and second inflatable tubes of said sun shield are generally perpendicular to each other.

3. The inflatable swimming pool assembly as defined in claim 2, wherein said sun shield further has a cross-shaped inflatable tube unit, which includes a long tubular portion with two ends that are respectively in fluid communication with said intersections, and a short tubular portion that has a middle portion crossing and in fluid communication with said long tubular portion, and two ends respectively in fluid communication with middle portions of said first and second inflatable tubes.

4. The inflatable swimming pool assembly as defined in claim 1, wherein each of said fastener units includes:

a first lug fixed on said top surface of said peripheral wall of said pool between said first and second halves, and having a side surface and a hole that is formed therethrough;

a second lug fixed on a corresponding one of said intersections of said sun shield near said first lug, and having a side surface and a hole that is formed therethrough;

a fastener cord extending through said holes in said first and second lugs; and two stop rods attached respectively to two ends of said cord, each of said rods having a middle portion that is connected fixedly to said cord, and two end portions that abut against said side surface of a corresponding one of said first and second lugs for retaining said intersections of said sun shield on said pool.

* * * * *